US009331403B2

(12) United States Patent
Yamanaka et al.

(10) Patent No.: US 9,331,403 B2
(45) Date of Patent: May 3, 2016

(54) BULB SOCKET AND LIGHTING DEVICE

(71) Applicant: YAZAKI CORPORATION, Tokyo (JP)

(72) Inventors: Hideki Yamanaka, Shizuoka (JP); Atsuro Murata, Shizuoka (JP); Ryohei Konishi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 42 days.

(21) Appl. No.: 14/444,468

(22) Filed: Jul. 28, 2014

(65) Prior Publication Data

US 2014/0334128 A1 Nov. 13, 2014

Related U.S. Application Data

(63) Continuation of application No. PCT/JP2013/000485, filed on Jan. 30, 2013.

(30) Foreign Application Priority Data

Feb. 3, 2012 (JP) ..... 2012-021979

(51) Int. Cl.

| | |
|---|---|
| ***H01R 4/48*** | (2006.01) |
| ***H01R 33/09*** | (2006.01) |
| ***F21V 5/04*** | (2006.01) |
| ***F21V 23/06*** | (2006.01) |

(52) U.S. Cl.

CPC .. *H01R 4/48* (2013.01); *F21V 5/04* (2013.01); *F21V 23/06* (2013.01); *H01R 33/09* (2013.01)

(58) Field of Classification Search

CPC ..... H01R 4/48; H01R 33/09; F21V 5/04; F21V 23/06

See application file for complete search history.

(56) References Cited

U.S. PATENT DOCUMENTS 8,534,882 B2 * 9/2013 Ohtsuka ..... B60Q 3/0203 362/365
2008/0186740 A1 * 8/2008 Huang ..... F21V 19/0005 362/652

FOREIGN PATENT DOCUMENTS

| | | |
|---|---|---|
| FR | 1 581 014 A | 9/1969 |
| JP | 53-38397 | 9/1978 |
| JP | 3-19288 U | 2/1991 |
| JP | 7-37201 Y2 | 8/1995 |
| JP | 2001-273959 A | 10/2001 |

(Continued)

OTHER PUBLICATIONS

International Search Report and Written Opinion of the International Search Report for PCT/JP2013/000485 dated Apr. 12, 2013.

(Continued)

*Primary Examiner* — Thomas M Sember
(74) *Attorney, Agent, or Firm* — Kenealy Vaidya LLP

(57) ABSTRACT

A pair of terminal portions of a bus bar (i.e. a terminal clamp) includes spring portions each of which is arranged to exert a pushing force in a direction of sandwiching a base portion of a bulb, and contact portions each provided at a tip portion of the spring portion. A housing (i.e. a socket body) includes regulation portions located on opposite side of the terminal portions and arranged to abut on the terminal portions from opposite side of the base portion to regulate elastic deformation amount of the spring portions to be within a predetermined value.

12 Claims, 6 Drawing Sheets

(56) References Cited

FOREIGN PATENT DOCUMENTS

| | | | |
|---|---|---|---|
| JP | 4006839 | B2 | 11/2007 |
| JP | 2008-226484 | A | 9/2008 |
| JP | 2009-99398 | A | 5/2009 |
| JP | 2010-129314 | A | 6/2010 |
| JP | 2010-212066 | A | 9/2010 |

OTHER PUBLICATIONS

Japanese Office Action for the related Japanese Patent Application No. 2012-021979 dated Sep. 8, 2015.

* cited by examiner

BULB SOCKET AND LIGHTING DEVICE

STATEMENT OF RELATED CASES

This application is a continuation application under 35 U.S.C. §120 of PCT Application No. PCT/JP2013/000485, filed on Jan. 30, 2013, and claims priority to Japanese patent application no. 2012-021979 filed on Feb. 3, 2012, under 35 U.S.C. §119, the entireties of which are hereby incorporated by reference herein.

TECHNICAL FIELD

The present invention relates to a bulb socket arranged to hold a bulb and a lighting device.

BACKGROUND ART

One example of a proposed bulb socket structure for use in an in-vehicle room lighting device provided at a ceiling of a vehicle such as an automobile, is provided with a socket body made of resin for mounting a bulb such as a wedge base bulb, and a pair of power-supply terminals (i.e. terminal clamps) provided at the socket body, wherein a base portion (i.e. a basal portion) of the bulb is inserted into a mounting hole of the socket body and is sandwiched by the pair of power-supply terminals (refer to Patent Literature 1, for example). For a bulb socket structure disclosed in Patent Literature 1, as shown in FIG. 8, a pair of power-supply terminals 101 is provided with a pair of holding pieces 102 for holding a base portion 111 of a bulb 110, so that by inserting the base portion 111 between the pair of holding pieces 102, the pair of holding pieces 102 is elastically deformed in a direction away from each other and holds the base portion 111 with a pushing force associated with this deformation. Furthermore, as shown in FIG. 9, there is provided a spacer 120 attached to a mounting hole 103 of a socket 100 and having a regulation wall 121. By allowing the regulation walls 121 to abut on the holding pieces 102 which are elastically deformed by the insertion of the base portion 111, the excessive deformation of the holding pieces 102 can be inhibited.

CITATION LIST

Patent Literature

[Patent Literature 1]
Japan Patent Application Publication No. 2010-212066

SUMMARY OF INVENTION

Technical Problem

However, the conventional bulb socket such as the one disclosed in Patent Literature 1 has a drawback that, the conventional bulb socket requires the spacer 120 which is a separate component separate from the socket 100 to guide the bulb 110 and to regulate the excessive deformation of the holding pieces 102, causing an increase in number of components. Moreover, since the spacer 120 is inserted into and engaged with the mounting hole 103 of the socket 100, the size of the socket 100 is increased. Furthermore, there is also a drawback that, due to the spacer 120 which projects from the socket 100, there is a further increase in size of the entire bulb socket and a lighting device.

Therefore, an object of the present invention is to provide a bulb socket and a lighting device which can reduce the number of components, reduce the size of device and inhibit the excessive deformation of a terminal clamp.

Solution to Problem

The present invention provides, in a first aspect, a bulb socket arranged to hold a bulb having a light-emitting portion and a base portion, the bulb socket including, a socket body having an insertion hole arranged to receive the base portion of the bulb, and a terminal clamp attached to the socket body to be electrically connected to the base portion, wherein the terminal clamp includes a fixation portion arranged to be fixed to the socket body, and a pair of terminal portions extending from the fixation portion and arranged to sandwich the base portion of the bulb, each of the pair of terminal portions includes a spring portion arranged to exert a pushing force in a direction of sandwiching the base portion of the bulb, and a contact portion provided at a tip of the spring portion, and the socket body is provided with a pair of regulation portions arranged opposed to the terminal portions, respectively, and arranged to abut on the terminal portions from opposite side of the base portion to regulate elastic deformation amount of the spring portions to be within a predetermined value.

The present invention provides, in a second aspect, the bulb socket according to the first aspect, wherein the regulation portion includes a slanted-face portion, the slanted-face portion being slanted away from the terminal portion as extending from a location on opposite side of a base end portion of the spring portion adjacent to the fixation portion of the terminal clamp towards a location on opposite side of the contact portion of the terminal portion.

The present invention provides, in a third aspect, the bulb socket according to the first or the second aspect, wherein the contact portions of the pair of terminal portions include bent portions and curved portions, the bent portion being bent from a portion continued from the spring portion in a direction toward the other terminal portion, and the curved portion having a curved surface formed continuously from the bent portion and arranged convex to the other terminal portion, wherein the regulation portion is arranged to abut on at least one of the bent portion, a tip portion of the curved portion and the base end portion of the spring portion.

The present invention provides, in a forth aspect, the bulb socket according to the third aspect, wherein the regulation portion includes a first abutting portion arranged to abut on the bent portion of the contact portion and a second abutting portion arranged to abut on the tip portion of the curved portion of the contact portion, wherein the second abutting portion is located closer to an opening side of the insertion hole than the first abutting portion, and the second abutting portion is formed into a stepwise shape such that a distance from a center of the insertion hole is different between the second abutting portion and the first abutting portion.

The present invention provides, in a fifth aspect, a lighting device including the bulb socket according to any one of the first through forth aspects, further including a bulb arranged to be held by the bulb socket, a protection cover arranged to cover the bulb socket and the bulb, and a transmission lens fixed to the bulb socket and to a protection cover and arranged to transmit light irradiated from a light-emitting portion of the bulb.

Advantageous Effects of Invention

According to the first aspect of the present invention, the spring portions are arranged to elastically deform due to the insertion of the base portion of the bulb between the pair of terminal portions, and the regulation portions are arranged to abut on the terminal portions moving away from each other. Thus, the excessive deformation of the spring portions can be inhibited. Furthermore, since the socket body is provided with the regulation portions, there is no need to prepare a separate member, thus the bulb socket can be downsized.

According to the second aspect of the present invention, since the regulation portion is provided with the slanted-face portion, the slanted-face portion can be arranged parallel with the tip portion of the terminal portion (i.e. a portion adjacent to the contact portion) which moves with the elastic deformation of the spring portion. Thus, the terminal portion and the regulation portion can be abutted onto each other in a reliable manner.

According to the third aspect of the present invention, the contact portion is provided with the bent portion and the curved portion. Thus, by allowing at least one of the bent portion, the tip portion of the curved portion and the base end portion of the spring portion to abut on the regulation portion, the excessive deformation of the spring portion can be inhibited in a reliable manner. In addition, by allowing more than one of the bent portion, the tip portion of the curved portion and the base end portion of the spring portion to abut on the regulation portion, the excessive deformation of the spring portion can be inhibited even more reliably.

According to the forth aspect of the present invention, the regulation portion is provided with the first abutting portion and the second abutting portion, and the second abutting portion is arranged closer to the opening of the insertion hole than the first abutting portion in a radial direction and formed into a stepwise shape. Thus, the bent portion and/or the tip portion of the curved portion can be abutted on the first abutting portion and the second abutting portion in a reliable manner, while maintaining a space for movement of the contact portion of the terminal portion.

According to the fifth aspect of the present invention, as the above-described bulb socket, the lighting device can inhibit the excessive deformation of the spring portions of the terminal portions, while reducing the number of components and downsizing of the bulb socket, thereby achieving a further cost reduction and space-saving of the lighting device. Furthermore, the elasticity weakening of the spring portion of the terminal portion can be prevented. Thus, the reduction in a force for holding the bulb can be prevented, thereby preventing loosening and removal of the bulb, and at the same time, there can be provided good electrical contact between the terminal clamp and the bulb, thereby preventing lighting failure of the bulb. Moreover, since the bulb socket which holds the bulb is covered with the protection cover, an external force is prevented from being applied on the bulb, thereby preventing excessive stress on the spring portion.

DESCRIPTION OF EMBODIMENTS

Figure 1:
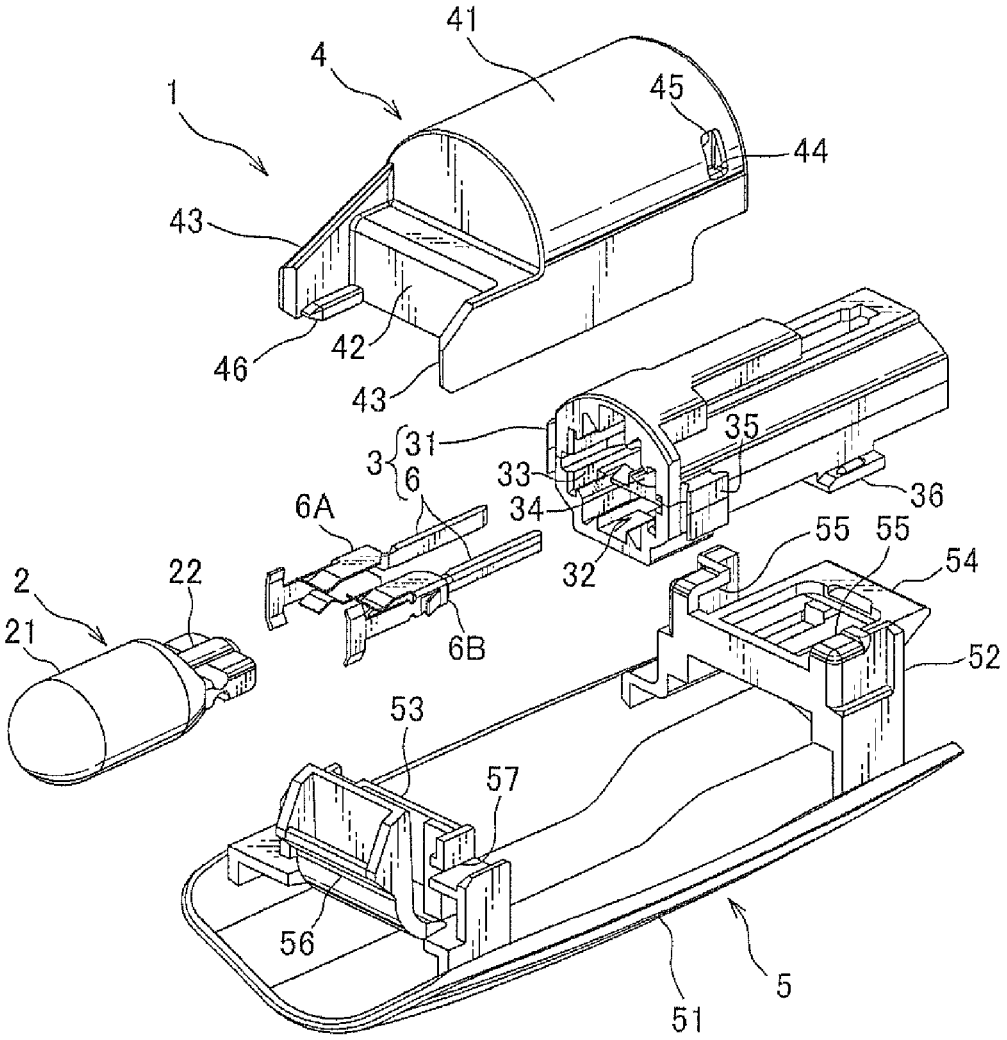
FIG. 1 is an exploded perspective view showing a lighting device according to one embodiment of the present invention.

In the following, a lighting device according to one embodiment of the present invention is explained in reference to FIGS. 1 through 7. A lighting device 1 according to this embodiment is a room lighting device to be attached to a roof trim or a door trim or the like located on an inner surface of a passenger room of a vehicle such as an automobile. Specifically, the lighting device 1 is suitable for use as a door courtesy lamp provided on a door trim. As shown in FIG. 1, the lighting device 1 includes a bulb (i.e. an electric bulb) 2, a bulb socket 3 arranged to hold the bulb 2, a protection cover 4 arranged to cover the bulb 2 and the bulb socket 3, and a transmission lens 5 fixed to the bulb socket 3 and to the protection cover 4 and arranged to transmit light irradiated from the bulb 2.

Figure 2:
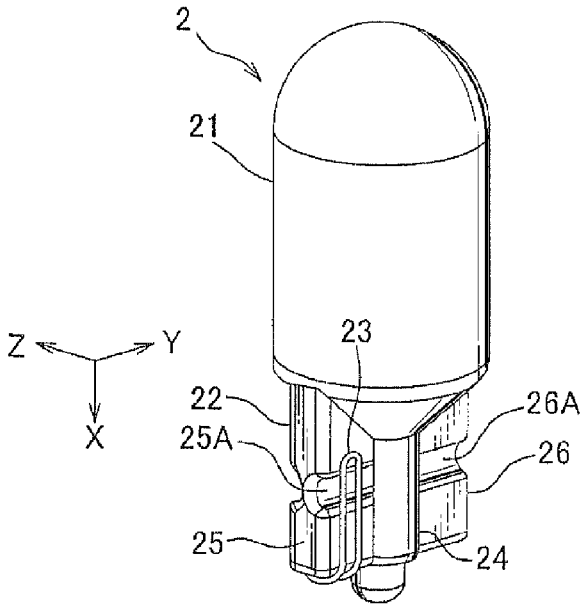
FIG. 2 is a perspective view showing a bulb used for the lighting device.
Figure 3A:
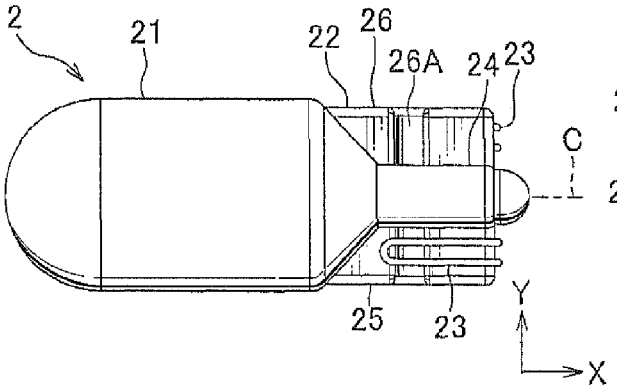
FIG. 3A shows one side of the bulb.
Figure 3B:
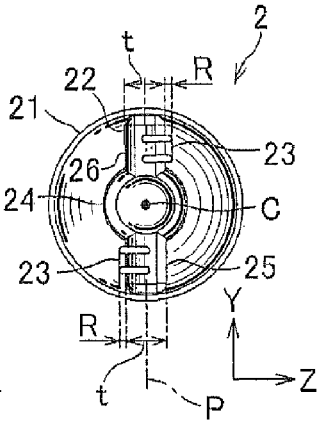
FIG. 3B shows another side of the bulb.
Figure 3C:
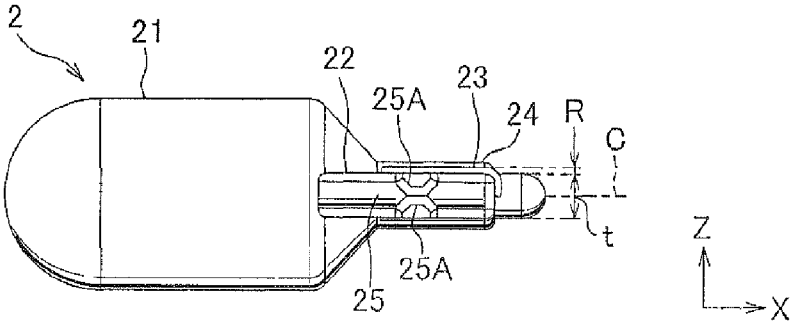
FIG. 3C shows another side of the bulb.

As shown in FIGS. 2 and 3, the bulb 2 is a wedge based bulb including a light-emitting portion 21 having a filament and such thereinside, a base portion 22 formed continuously from the light-emitting portion 21 along an axial direction of the light-emitting portion 21 and arranged to function as a mouthpiece, and a pair of contact leads 23 arranged along a side face of the base portion 22. The base portion 22 is an insulating resin component and includes a cylinder portion 24 extending from a center of a base end portion of the light-emitting portion 21, and a pair of plate portions 25, 26 extending radially in opposite directions with respect to each other.

The cylinder portion 24 extends along a direction of insertion of the bulb 2 with respect to the bulb socket 3 (i.e. X direction shown in FIG. 3). The base portion 22 is formed in line symmetric with respect to a center axis C of the cylinder portion 24 arranged along the direction of insertion. In other words, the base portion 22 is symmetrical with respect to the center axis C of the cylinder portion 24 so as to be symmetric with respect to both directions of a direction of extension of the plate portions 25, 26 (i.e. Y direction shown in FIG. 3) and a thickness direction of the plate portions 25, 26 (i.e. Z direction shown in FIG. 3). Furthermore, groove portions 25A, 26A are formed at a middle portion of the respective plate portions 25, 26 along the direction of insertion, the groove portions 25A, 26A being shaped like a groove formed along a direction of extension. In the following, the direction of insertion of the bulb 2 is indicated as the X direction, and the direction of extension of the plate portion 25, 26 is indicated as the Y direction, and the thickness direction of the plate portion 25, 26 is indicated as the Z direction.

The contact leads 23 are conductive wire material made, for example, of a copper wire which is connected to a filament or the like inside of the light-emitting portion. One of the contact leads 23 forms a positive electrode or a negative electrode of the bulb 2, and the other one of the contact leads 23 forms a negative electrode or a positive electrode of the bulb 2. The pair of contact leads 23 projects from an end face of the respective plate portions 25, 26 in the direction of insertion. The one of the contact leads 23 extends along one side of the plate portion 25 toward the light-emitting portion 21 in the direction of insertion, and other one of the contact leads 23 extends along the other side of the plate portion 26 toward the light-emitting portion 21 in the direction of insertion, so that the respective contact leads 23 are attached to respective surfaces of the plate portions 25, 26. In other words, a shaft diameter of the respective contact leads 23 is projecting from respective sides 25B, 26B, the shaft diameter being a projection length R of the contact lead 23 from the surface of the plate portion 25, 26.

Figure 4:
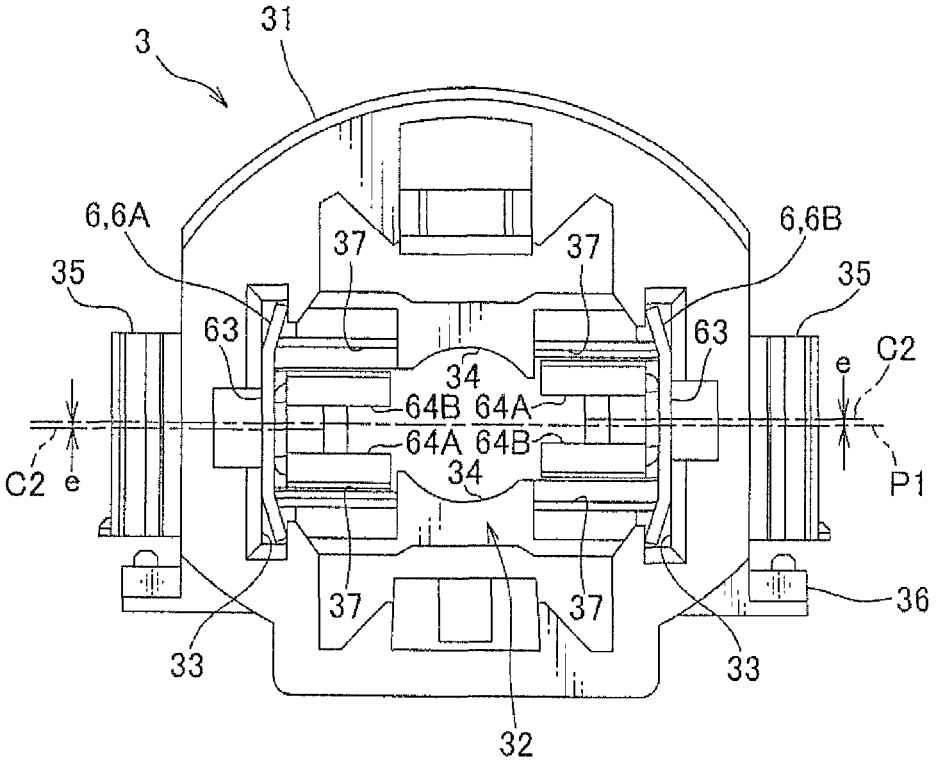
FIG. 4 is a front view showing a bulb socket of the lighting device.

As shown in FIGS. 1 and 4, the bulb socket 3 includes a housing 31 as a socket body having an insertion hole 32 for receiving the base portion 22 of the bulb 2, and a bus bar 6 (i.e. a first bus bar 6A and a second bus bar 6B) as a pair of terminal clamps provided inside of the housing 31 and electrically connected to the contact leads 23 of the bulb 2. The housing 31 is a single-piece molding made of an insulating resin and is formed into a tubular shape. Inside of the insertion hole 32, there are provided a pair of terminal holding portions 33 arranged to hold the terminal clamp 6 and bulb guide portions 34 arranged to guide and locate the cylinder portion 24 of the bulb 2 along the direction of insertion. A cover lock portion 35 arranged to lock the protection cover 4 and a lens engagement portion 36 arranged to engage with the transmission lens 5 are formed on an outer surface of the housing 31. The housing 31 includes an electric wire not shown wired to the housing 31 through the protection cover 4. This electric wire is connected to the bus bar 6 inside of the housing 31 to supply power to the bulb 2. The bulb 2 is located and held with respect to the housing 31 such that a center plane P, which passes through the center axis C and lies along the Y direction as shown in FIG. 3, is matched with a center plane P1 of the insertion hole 32 shown in FIG. 4.

Figure 5:
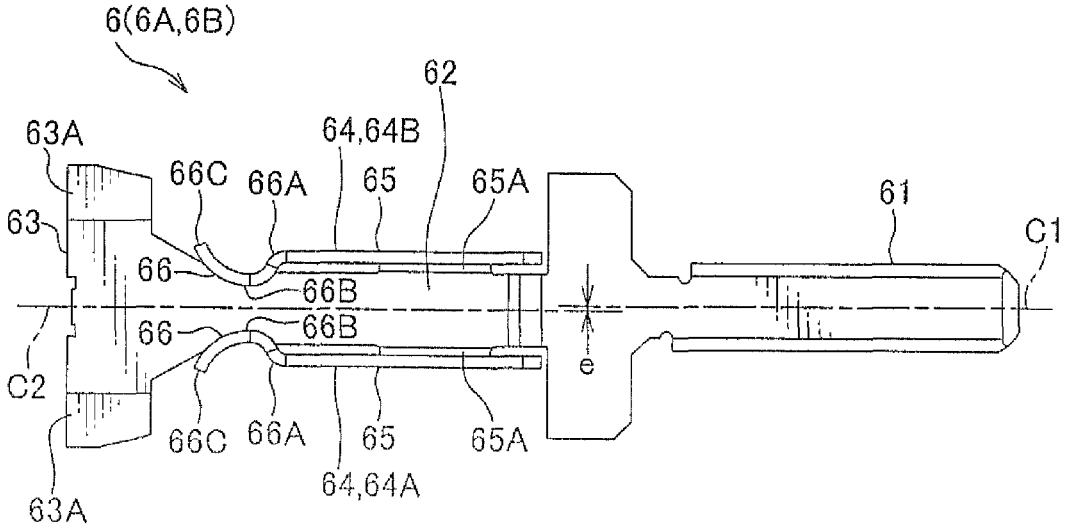
FIG. 5 is a side view showing a terminal clamp provided to the bulb socket.

The bus bar 6 is formed by punching and bending a conductive metal plate. As shown in FIG. 5, the bus bar 6 includes a fixation portion 61 fixed onto the housing 31 and connected to an electric wire, an extending portion 62 extending from the fixation portion 61, a widened portion 63 located at a tip of the extending portion 62 and having a broadened width, and a pair of terminal portions 64 (i.e. a first terminal portion 64A and a second terminal portion 64B) which is bent at a middle portion of the extending portion 62 in a continuous fashion. In this embodiment, the first bus bar 6A and the second bus bar 6B are made of materials having the same shape and configuration in common. As shown in FIG. 4, the first bus bar 6A and the second bus bar 6B are opposed to each other in a minor reversed fashion, that is, the first bus bar 6A and the second bus bar 6B are attached to the housing 31 in line symmetric to each other with respect to a center axis of the insertion hole 32 (i.e. an axis corresponding to the center axis C of the bulb 2).

The fixation portion 61 is inserted into back of the insertion hole 32 of the housing 31 along the same direction with the direction of insertion of the bulb 2. The fixation portion 61 is formed into an elongated plate shape formed along the direction of insertion of the bulb 2 and has a predetermined width with a center axis C1. The extending portion 62 is bent into a crank-shape and is extending towards an opening of the insertion hole 32. The widened portion 63 extends from the tip of the extending portion 62 (i.e. an end of the insertion hole 32 adjacent the opening) to both sides so as to intersect the direction of insertion. In other words, the extending portion 62 and the widened portion 63 form a T-like shape. The widened portion 63 includes obtusely-bent hold portions 63A formed on both ends of the widened portion 63. The hold portions 63A are held by the terminal holding portions 33 of the housing 31 to regulate the movement of the bus bar 6.

Each of the first terminal portion 64A and the second terminal portion 64B in the pair of terminal portions 64 has a spring portion 65 formed continuously from the extending portion 62 and extending in the direction of insertion of the bulb 2, and a contact portion 66 provided at a tip of the spring portion 65 and bent in a curved-face shape. The pair of terminal portions 64 is arranged symmetrically with respect to a center axis C2 along the direction of insertion of the bulb 2 to sandwich the base portion 22 of the bulb 2 between the contact portions 66 of the respective terminal portions 64. The spring portion 65 is extending in a cantilever fashion from a base end portion 65A, a location bent from the extending portion 62, towards the opening of the insertion hole 32 and is arranged elastically deformable so as to allow the contact portions 66 of the respective terminal portions 64 to move away from and closer to each other. The contact portion 66 of the terminal portion 64 includes a bent portion 66A which is bent in a direction from a portion continued from the tip portion of the spring portion 65 toward the other terminal portion 64, and a curved portion 66B having a curved surface formed continuously from the bent portion 66A and arranged convex to the other terminal portion 64 so that a tip portion 66C of the curved portion 66B is located distant from the center axis C2 than the spring portion 65.

The protection cover 4 is a single-piece molding made of an insulating resin and includes a cover body portion 41 formed into a substantial semicylinder shape, an end face portion 42 formed at one end portion of the cover body portion 41 and arranged to cover the light-emitting portion 21 of the bulb 2 attached to the bulb socket 3, and a pair of flange portions 43 formed to project with respect to the end face portion 42. Inside of the cover body portion 41, there are provided a reflection face arranged to reflect the light irradiated from the light-emitting portion 21 of the bulb 2 towards the transmission lens 5, and a latch portion 44 arranged to be latched onto the cover lock portion 35. The latch portion 44 can be latched onto the cover lock portion 35 by pushing the protection cover 4 downward toward the bulb socket 3 and can be released from the latch by a operation through a penetration portion 45 formed on a side of the cover body portion 41. In addition, the pair of flanges 43 includes lens engagement portions 46 arranged to engage with the transmission lens 5.

The transmission lens 5 includes a lens body 51 formed into a suitable curved-plate shape and made of transparent or translucent resin, and a first attachment portion 52 and a second attachment portion 53 which are arranged to project from an inner face of the lens body 51. The first attachment portion 52 includes a lock piece 54 projecting outward along a rear end portion of the bulb socket 3, and a pair of first engagement portions 55 arranged to engage with lens engagement portions 36 of the bulb socket 3. The second attachment portion 53 includes a lock portion 56 arranged to engage with an interior material of a vehicle not shown, and a pair of second engagement portions 57 arranged to engage with the lens engagement portions 46 of the protection cover 4.

The lighting device 1 described above is assembled and attached to the interior material of the vehicle as described below. Firstly, a base portion 22 is inserted into the insertion hole 32 of the bulb socket 3 having the bus bar 6 attached to the housing 31 to hold the bulb 2, and the latch portion 44 of the protection cover 4 is latched onto the cover lock portion 35 of the bulb socket 3, thereby combining the bulb 2, the bulb socket 3 and the protection cover 4 together to form a function part. Next, the lens engagement portions 36, 46 of the bulb socket 3 and the protection cover 4 are engaged in a sliding fashion with the first and the second engagement portions 55, 57 of the transmission lens 5 to attach the transmission lens 5 to the function part to assemble the lighting device 1. The lighting device 1 which is assembled in a manner as described above is then inserted into a recess and such formed on the interior material from the side of the protection cover 4, and the lock piece 54 and the lock portion 56 of the transmission lens 5 are engaged with attachment portions of the interior material, thereby completing the attachment of the lighting device 1 to the vehicle.

The bus bar 6 is attached to the housing 31 of the bulb socket 3 by inserting the bus bar 6 into the terminal holding portion 33 so the center plane P1 of the insertion hole 32 is matched with the center axis C1 of the fixation portion 61. Here, for the bus bar 6, the center axis C1 of the fixation portion 61 and the center axis C2 of the extending portion 62 and the pair of terminal portions 64 are eccentrically-arranged with respect to each other, so that the center axis C2 is displaced from the center axis C1 towards the first terminal portion 64A for an eccentric distance e. This eccentric distance e of the pair of terminal portions 64 is set in accordance with the projection length R of the contact leads 23 located at the base portion 22 of the bulb 2. Specifically, as shown in FIG. 3, the eccentric distance e is set such that the center axis C2 of the pair of terminal portions 64 are matched with a location corresponding to ½ of the distance which is the sum of the thickness t of the plate portion 25, 26 at the base portion 22 and the projection length R of the contact lead 23 (i.e., t+R), that is a location which is eccentrically-displaced from the center plane P of the thickness direction of the plate portion 25, 26 towards the contact lead 23 for ½ of the projection length R (in other words, e=R/2).

Next, a structure for holding the bulb 2 to the bulb socket 3 is explained in reference to FIGS. 6 and 7. Inside of the insertion hole 32 of the housing 31, there is provided regulation portions 37 located on opposite side of the terminal portions 64 of the bus bar 6 and arranged to regulate the elastic deformation amount of the spring portions 65 to be within a predetermined value. As shown in FIG. 7, the regulation portion 37 includes a slanted-face portion 37A which is slanted away from the terminal portion 64 as it extends from a location on opposite side of the base end portion 65A of the spring portion 65 of the terminal portion 64 towards a location on opposite side of the contact portion 66, a flat-face portion 37B formed continuously from the slanted-face portion 37A and extending towards the opening of the insertion hole 32 in parallel with the direction of insertion, and a stepwise portion 37C formed into a stepwise shape and formed from the flat-face portion 37B towards the opening of the insertion hole 32 in a direction away from the terminal portion 64. As for the regulation portion 37, the flat-face portion 37B corresponds to a first abutting portion which is arranged to abut on the bent portion 66A of the contact portion 66, and the stepwise portion 37C corresponds to a second abutting portion arranged to abut on the tip portion 66C. In addition, the slanted-face portion 37A may be arranged to abut on the base end portion 65A of the spring portion 65.

Figure 6A:
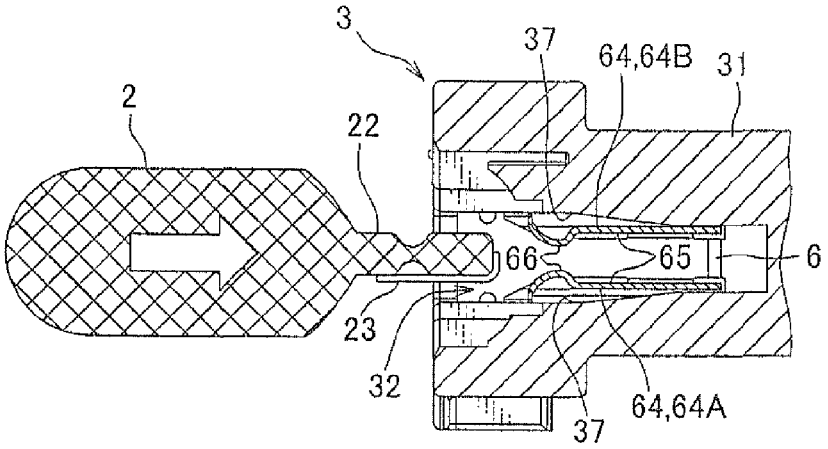
FIG. 6A is a cross-sectional view which illustrates a procedure of attaching the bulb to the bulb socket.
Figure 6B:
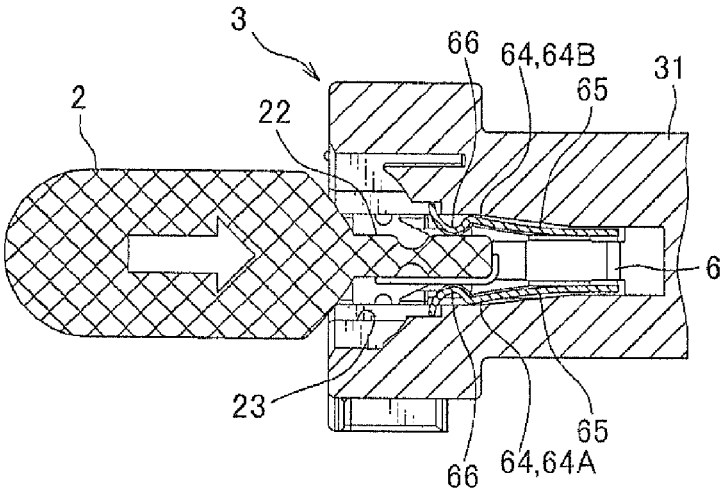
FIG. 6B is a cross-sectional view which illustrates a procedure of attaching the bulb to the bulb socket.

Next, as shown in FIG. 6A, when the base portion 22 of the bulb 2 is inserted into the insertion hole 32 of the housing 31, the contact lead 23 at the base portion 22 is slidably contacted to the contact portion 66 of the first terminal portion 64A, and the side of the plate portion 25 (or of the plate portion 26) at the base portion 22 is slidably contacted to the contact portion 66 of the second terminal portion 64B. By doing so, as shown in FIGS. 6B and 7, the first terminal portion 64A and the second terminal portion 64B are pushed outward in a direction away from each other, and the spring portions 65 of the respective terminal portions 64 are elastically deformed, and thus a pushing force acts to sandwich the base portion 22 between the respective contact portions 66. At this time, since the eccentric distance e of the respective terminal portions 64 is set as described above, the movement distances of the respective contact portions 66 become the same for the first terminal portion 64A and the second terminal portion 64B. Thus, the same pushing force is exerted from the respective spring portions 65.

Figure 6C:
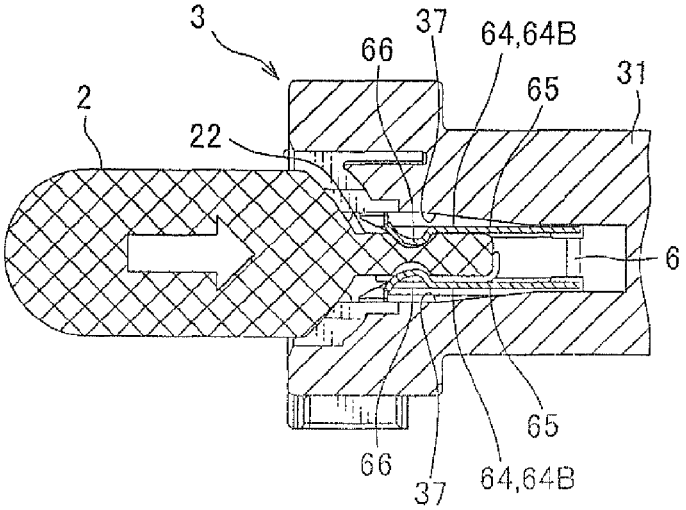
FIG. 6C is a cross-sectional view which illustrates a procedure of attaching the bulb to the bulb socket.
Figure 7A:
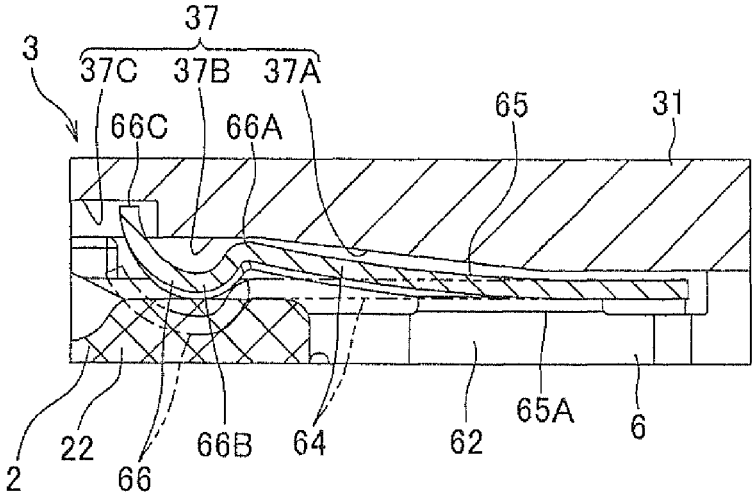
FIG. 7A is an enlarged cross-sectional view which illustrates function of the bulb socket.
Figure 7B:
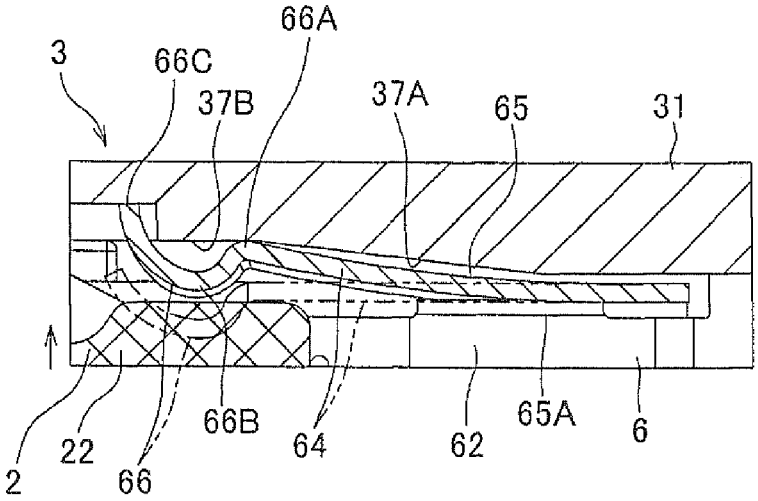
FIG. 7B is an enlarged cross-sectional view which illustrates function of the bulb socket.
Figure 8:
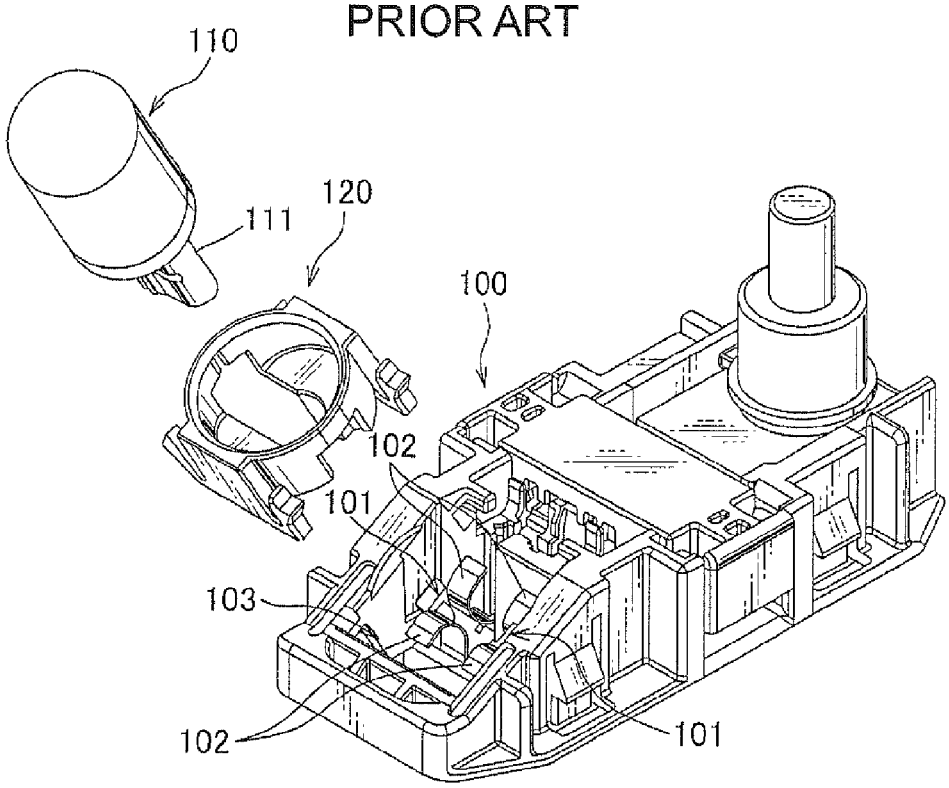
FIG. 8 PRIOR ART
FIG. 8 is an exploded perspective view showing a conventional lighting device.
Figure 9:
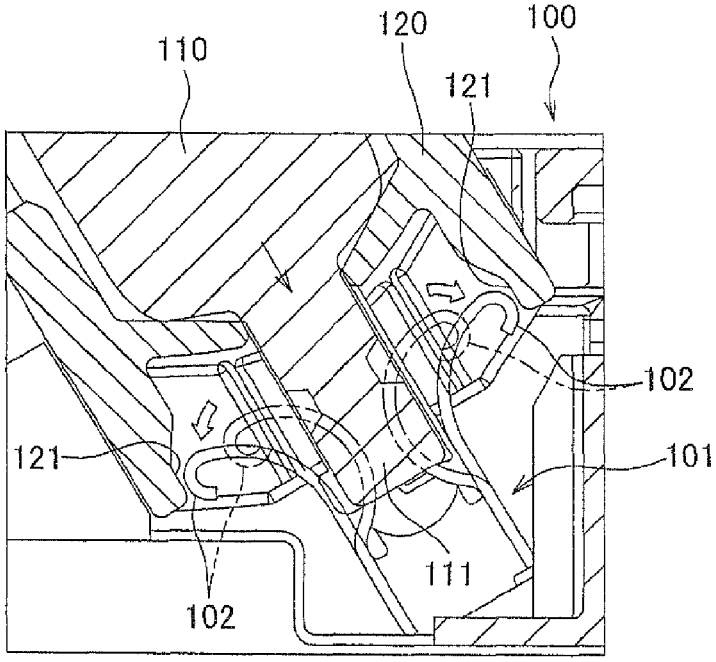
FIG. 9 PRIOR ART
FIG. 9 is a partial cross-sectional view showing a holding state of a bulb at the terminal clamp.

When the terminal portions 64 are pushed outward by the base portion 22 due to the insertion of the bulb 2 as described above, the bent portions 66A of the contact portions 66 are moved closer to the flat-face portions 37B, and the tip portions 66C of the contact portions 66 are moved closer to the stepwise portions 37C of the regulation portions 37, as shown in FIG. 7A. Here, in the case the force acts in a direction intersecting the direction of insertion of the bulb 2, as shown in FIG. 7B, the bent portion 66A abuts on the flat-face portion 37B, and at the same time, or around this time, the tip portion 66C abuts on the stepwise portion 37C. Thus, the movement of the contact portion 66, i.e. the elastic deformation of the spring portion 65, is regulated to be within a predetermined position. After that, by further inserting the bulb 2 as shown in FIG. 6C, the contact portions 66 of the respective terminal portions 64 are fitted downward into the grooves 25A, 26A of the plate portions 25, 26 located at the base portion 22. Thus, the base portion 22 is sandwiched between the terminal portions 64 and is locked in the direction of insertion, thereby achieving the holding state in which the bulb 2 is held in the bulb socket 3.

Furthermore, in the holding state of the bulb 2, even if a force acts to the bulb 2 in a direction intersecting the direction of insertion, one of the terminal portions 64 sandwiching the base portion 22 is deformed so as to move closer to the regulation portion 37, and the bent portion 66A and the tip portion 66C of the contact portion 66 are abutted on the stepwise portion 37C of the flat-face portion 37B of the regulation portion 37. Thus, the deformation of the terminal portion 64 can be regulated and the excessive deformation of the spring portion 65 can be inhibited.

According to this embodiment, since the deformation of the terminal portions 64 is regulated by the regulation portions 37, the excessive deformation and the stress of the spring portion 65 can be inhibited, thereby preventing the elasticity weakening of the spring portion 65. In addition, since the regulation portions 37 are integrally formed to the housing 31, there is no need to prepare a separate member, thereby downsizing the bulb socket 3 and the lighting device 1. Furthermore, since the elasticity weakening of the spring portion 65 can be prevented, the reduction in a force for holding the bulb 2 can be prevented, thereby preventing loosening and removal of the bulb 2, and there can be provided good electrical contact between the bus bar 6 and the contact lead 23 of the bulb 2, thereby preventing lighting failure of the bulb 2.

Furthermore, the above-described embodiments are only representative embodiments of the present invention, and the present invention is not limited to these embodiments. That is, the embodiments can be modified and performed in various ways without departing from the scope of the present invention.

For example, the above-described embodiment illustrates the lighting device 1 arranged to be attached to a vehicle such as an automobile; however, the lighting device of the present invention is not limited to be attached to a vehicle such as an automobile, but may be a lighting device to be provided to a structure such as a building. Furthermore, the light device according to the above-described embodiment is provided with the protection cover 4 and the transmission lens 5 in addition to the bulb socket 3 for holding the bulb 2; however, the protection cover 4 and the transmission lens 5 are not necessary and may be omitted in a suitable manner. Alternatively, the lighting device may include a member other than the protection cover 4 and the transmission lens 5. In addition, in the present invention, the bulb is not limited to the bulb 2 which is a wedge base bulb, and various electric bulbs can be utilized. Moreover, the type of the light-emitting portion of the bulb is not limited to an incandescent lamp, a halogen lamp, a mercury lamp and such having a filament or the like thereinside, but may utilize arbitral lamps including a fluorescent lamp, a LED lamp and such.

REFERENCE SIGNS LIST

1 lighting device
2 bulb
3 bulb socket
4 protection cover
5 transmission lens
6 bus bar (terminal clamp)
21 light-emitting portion
22 base portion
31 housing (socket body)
32 insertion hole
37 regulation portion
37A slanted-face portion
37B flat-face portion (first abutting portion)
37C stepwise portion (second abutting portion)
61 fixation portion
64 terminal portion
64A first terminal portion
64B second terminal portion
65 spring portion
66 contact portion
66A bent portion
66B curved portion
66C tip portion

The invention claimed is:

1. A bulb socket arranged to hold a bulb having a light-emitting portion and a base portion, the bulb socket comprising, a socket body having an insertion hole arranged to receive the base portion of the bulb, and a terminal clamp attached to the socket body to be electrically connected to the base portion, wherein the terminal clamp includes a fixation portion arranged to be fixed to the socket body, and a pair of terminal portions extending from the fixation portion and arranged to sandwich the base portion of the bulb, wherein each of the pair of terminal portions includes a spring portion arranged to exert a pushing force in a direction of sandwiching the base portion of the bulb, and a contact portion provided at a tip of the spring portion, wherein the socket body is provided with a pair of regulation portions respectively arranged in a way opposing to each of the terminal portions, the pair of regulation portions being arranged to abut against the terminal portions from an opposite side with respect to the base portion so as to restrict an amount of elastic deformation of the spring portions within a predetermined numerical range, wherein in the terminal clamp, a first center axis extends from the fixation portion to the pair of terminal portions and a second center axis intervenes between the pair of terminal portions, the first and second center axes being eccentrically arranged with respect to each other, and wherein in the socket body, each pair of regulation portions has an equivalent distance between the corresponding portions of the pair of terminal portions.

2. The bulb socket according to claim 1, wherein the regulation portion includes a slanted-face portion, the slanted-face portion being slanted away from the terminal portion as extending from a location on opposite side of a base end portion of the spring portion adjacent to the fixation portion of the terminal clamp towards a location on opposite side of the contact portion of the terminal portion.

3. The bulb socket according to claim 2, wherein the contact portions of the pair of terminal portions include bent portions and curved portions, the bent portion being bent from a portion continued from the spring portion in a direction toward the other terminal portion, and the curved portion having a curved surface formed continuously from the bent portion and arranged convex to the other terminal portion, wherein the regulation portion is arranged to abut on at least one of the bent portion, a tip portion of the curved portion and the base end portion of the spring portion.

4. The bulb socket according to claim 3, wherein the regulation portion includes a first abutting portion arranged to abut on the bent portion of the contact portion and a second abutting portion arranged to abut on the tip portion of the curved portion of the contact portion, wherein the second abutting portion is located closer to an opening side of the insertion hole than the first abutting portion, and the second abutting portion is formed into a stepwise shape such that a distance from a center of the insertion hole is different between the second abutting portion and the first abutting portion.

5. A lighting device comprising the bulb socket according to claim 4, further comprising a bulb arranged to be held by the bulb socket, a protection cover arranged to cover the bulb socket and the bulb, and a transmission lens fixed to the bulb socket and to a protection cover and arranged to transmit light irradiated from a light-emitting portion of the bulb.

6. A lighting device comprising the bulb socket according to claim 3, further comprising a bulb arranged to be held by the bulb socket, a protection cover arranged to cover the bulb socket and the bulb, and a transmission lens fixed to the bulb socket and to a protection cover and arranged to transmit light irradiated from a light-emitting portion of the bulb.

7. A lighting device comprising the bulb socket according to claim 2, further comprising a bulb arranged to be held by the bulb socket, a protection cover arranged to cover the bulb socket and the bulb, and a transmission lens fixed to the bulb socket and to a protection cover and arranged to transmit light irradiated from a light-emitting portion of the bulb.

8. The bulb socket according to claim 1, wherein the contact portions of the pair of terminal portions include bent portions and curved portions, the bent portion being bent from a portion continued from the spring portion in a direction toward the other terminal portion, and the curved portion having a curved surface formed continuously from the bent portion and arranged convex to the other terminal portion, wherein the regulation portion is arranged to abut on at least one of the bent portion, a tip portion of the curved portion and the base end portion of the spring portion.

9. The bulb socket according to claim 8, wherein the regulation portion includes a first abutting portion arranged to abut on the bent portion of the contact portion and a second abutting portion arranged to abut on the tip portion of the curved portion of the contact portion, wherein the second abutting portion is located closer to an opening side of the insertion hole than the first abutting portion, and the second abutting portion is formed into a stepwise shape such that a distance from a center of the insertion hole is different between the second abutting portion and the first abutting portion.

10. A lighting device comprising the bulb socket according to claim 9, further comprising a bulb arranged to be held by the bulb socket, a protection cover arranged to cover the bulb socket and the bulb, and a transmission lens fixed to the bulb socket and to a protection cover and arranged to transmit light irradiated from a light-emitting portion of the bulb.

11. A lighting device comprising the bulb socket according to claim 8, further comprising a bulb arranged to be held by the bulb socket, a protection cover arranged to cover the bulb socket and the bulb, and a transmission lens fixed to the bulb socket and to a protection cover and arranged to transmit light irradiated from a light-emitting portion of the bulb.

12. A lighting device comprising the bulb socket according to claim 1, further comprising a bulb arranged to be held by the bulb socket, a protection cover arranged to cover the bulb socket and the bulb, and a transmission lens fixed to the bulb socket and to a protection cover and arranged to transmit light irradiated from a light-emitting portion of the bulb.

* * * * *